United States Patent [19]

Poehlman

[11] 4,393,848

[45] Jul. 19, 1983

[54] CONTROL MECHANISM FOR SELECTIVELY OPERATING AN INTERNAL COMBUSTION ENGINE ON TWO FUELS

[75] Inventor: Arthur G. Poehlman, Oconomowoc, Wis.

[73] Assignee: Outboard Marine Corporation, Waukegan, Ill.

[21] Appl. No.: 314,225

[22] Filed: Oct. 23, 1981

[51] Int. Cl.[3] ..... F02M 21/02

[52] U.S. Cl. ..... 123/525; 48/180 R; 261/16; 123/575

[58] Field of Search ..... 123/525, 575, 527, 526; 261/16; 48/180 C, 180 R

[56] References Cited

U.S. PATENT DOCUMENTS

| | | | |
|---|---|---|---|
| 1,973,142 | 9/1934 | Day et al. | 123/527 |
| 2,315,882 | 4/1943 | Trimble et al. | 123/527 |
| 2,381,304 | 8/1945 | Merrill | 125/527 |
| 4,068,639 | 1/1978 | Cook | 123/525 |
| 4,227,497 | 10/1980 | Mathieson | 123/525 |
| 4,335,697 | 6/1982 | McLean | 123/525 |

OTHER PUBLICATIONS

Popular Mechanics, p. 16, Aug. 1979, "Dual Fuel Engergy Option".

*Primary Examiner*—Charles J. Myhre
*Assistant Examiner*—E. Rollins Cross
*Attorney, Agent, or Firm*—Michael, Best & Friedrich

[57] ABSTRACT

Disclosed herein is an apparatus which is adapted for controlling operation of an internal combustion engine which is selectively operable using gaseous fuel or liquid fuel, and which comprises a gaseous fuel supply line extending between the engine and a source of gaseous fuel, a liquid fuel supply line extending between the engine and a source of liquid fuel, and a control for controlling supply to the engine of the gaseous fuel and the liquid fuel, which control includes an operator controlled fuel selector switch movable between a gaseous fuel position and a liquid fuel position, which control is operable following prior engine operation with gaseous fuel and in response to movement of the fuel selector switch from the gaseous fuel position to the liquid fuel position for permitting liquid fuel flow through the liquid fuel supply line, for permitting continued gaseous fuel flow through the gaseous fuel supply line until initiation of liquid fuel combustion, and thereafter preventing further gaseous fuel flow through the gaseous fuel supply line until repositioning of the fuel selector switch to the gaseous fuel position, and which control is also operable following prior engine operation with liquid fuel and in response to movement of the fuel selector switch from the liquid fuel position to the gaseous fuel position for preventing further liquid fuel flow through the liquid fuel supply line, for preventing gaseous fuel flow through the gaseous fuel supply line until termination of liquid fuel combustion, and for thereafter permitting gaseous fuel flow through the gaseous fuel supply line until repositioning of the fuel selector switch to the liquid fuel position.

6 Claims, 1 Drawing Figure

Figure 1:
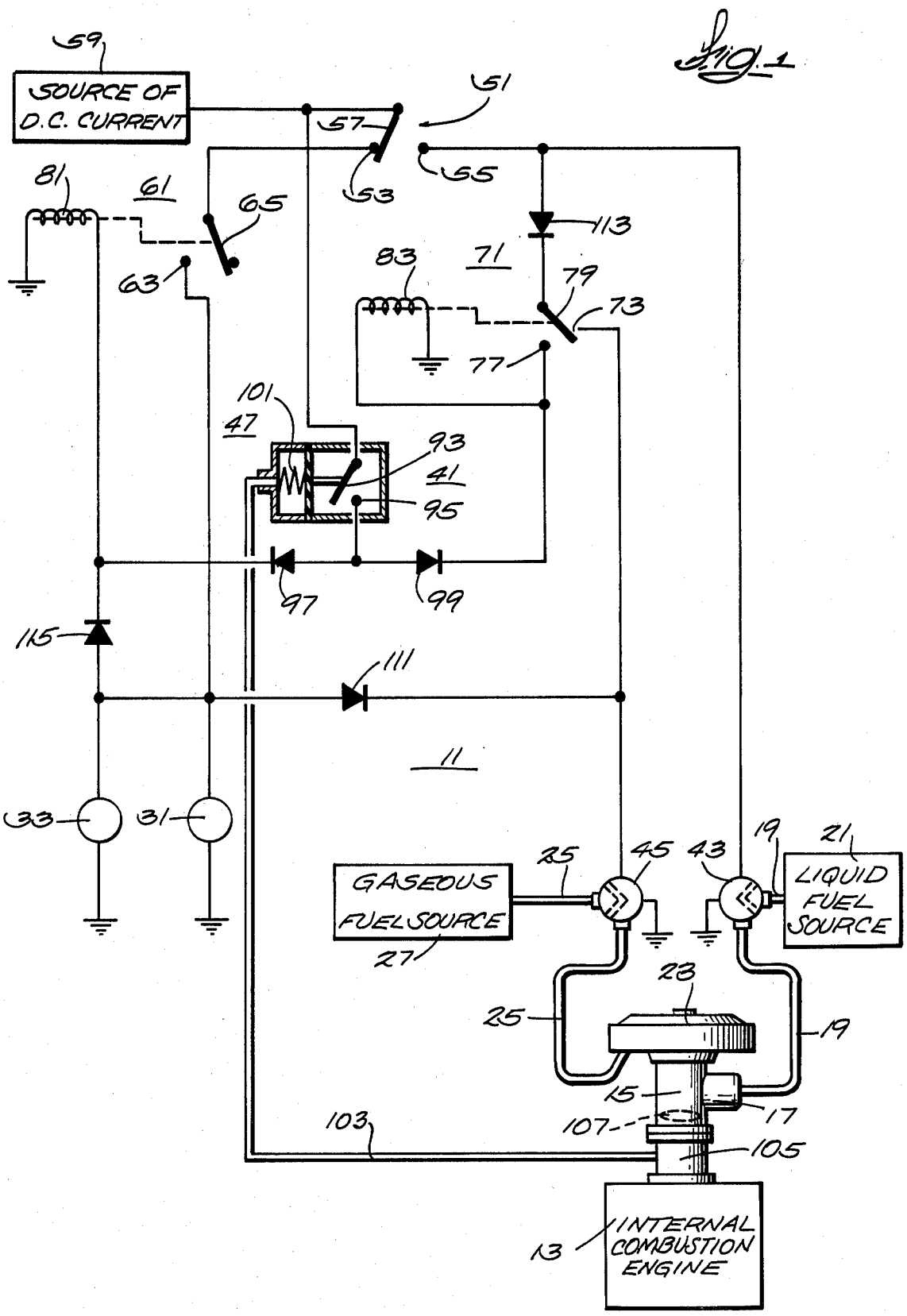

SOURCE OF D.C. CURRENT
59
51
57
53
55
81
61
65
63
113
83
71
79
73
77
101
47
93
41
95
97
99
115
111
11
33
31
GASEOUS FUEL SOURCE
27
25
45
43
19
21
LIQUID FUEL SOURCE
23
25
19
15
17
107
103
105
13
INTERNAL COMBUSTION ENGINE

CONTROL MECHANISM FOR SELECTIVELY OPERATING AN INTERNAL COMBUSTION ENGINE ON TWO FUELS

BACKGROUND OF THE INVENTION

The invention relates generally to operation of an internal combustion engine on two fuels. More particularly, the invention relates to selective operation of an internal combustion engine on a liquid fuel and on a gaseous fuel.

Still more particularly, the invention relates to means for controlling selective operation of an internal combustion engine on natural gas and on gasoline.

SUMMARY OF THE INVENTION

The invention provides an apparatus for controlling operation of an internal combustion engine which is selectively operable using gaseous fuel or liquid fuel, which apparatus comprises a gaseous fuel supply line extending between the engine and a source of gaseous fuel, a liquid fuel supply line extending between the engine and a source of liquid fuel, and means for controlling supply to the engine of the gaseous fuel and the liquid fuel, which control means includes an operator controlled fuel selector switch movable between a gaseous fuel position and a liquid fuel position, which control means is operable following prior engine operation with gaseous fuel and in response to movement of the fuel selector switch from the gaseous fuel position to the liquid fuel position for permitting liquid fuel flow through the liquid fuel supply line, for permitting continued gaseous fuel flow through the gaseous fuel supply line until initiation of liquid fuel combustion, and thereafter preventing further gaseous fuel flow through the gaseous fuel supply line until repositioning of the fuel selector switch to the gaseous fuel position, and which control means is also operable following prior engine operation with liquid fuel and in response to movement of the fuel selector switch from the liquid fuel position to the gaseous fuel position for preventing further liquid fuel flow through the liquid fuel supply line, for preventing gaseous fuel flow through the gaseous fuel supply line until termination of liquid fuel combustion, and for thereafter permitting gaseous fuel flow through the gaseous fuel supply line until repositioning of the fuel selector switch to the liquid fuel position.

In one embodiment of the invention, the control means also includes vacuum operated means responsive to engine vacuum conditions for controlling gaseous fuel flow through the gaseous fuel supply line.

In one embodiment of the invention, the apparatus comprises means for supplying a gaseous fuel to the engine, means for supplying liquid fuel to the engine, and control means connected to a source of vacuum which is responsive to engine operation and which varies relative to a predetermined level, which control means includes a fuel selector switch movable between a gaseous fuel position and a liquid fuel position, an electrically operated, normally closed gaseous fuel control valve which is located in the gaseous fuel supply means, which is operable between open and closed positions, and which is opened in response to electrical energization thereof, and an electrically operated, normally closed liquid fuel control valve which is located in said liquid fuel supply means, which is operable between open and closed positions, and which is opened in response to electrical energization thereof. The control means is operable, when the selector switch is in the liquid fuel position, to energize the liquid fuel control valve, thereby opening the liquid fuel control valve; is also operable, when the selector switch is in the liquid fuel position and in response to the presence of an amount of vacuum above the predetermined level to energize the gaseous fuel control valve; is also operable, when the selector switch is in the liquid fuel position and in response to the presence of an amount of vacuum below the predetermined level, to deenergize the gaseous fuel control valve, and thereby close the gaseous fuel control valve, and thereafter to retain the gaseous fuel control valve deenergized regardless of vacuum variation; is also operable, when the selector switch is in the gaseous fuel position, to deenergize the liquid fuel control valve, thereby closing the liquid fuel control valve; is also operable, when the selector switch is in the gaseous fuel position and in response to an amount of vacuum above the predetermined level, to deenergize the gaseous fuel control valve, thereby closing the gaseous fuel control valve; and is also operable, when the selector switch is in the gaseous fuel position and in response to an amount of vacuum below the predetermined level, to energize the gaseous fuel control valve and thereby open the gaseous fuel control valve, and thereafter to retain energization of the gaseous fuel control valve regardless of vacuum variation.

In one embodiment of the invention, the apparatus further includes electrically operated spark advance means electrically connected to the control means and operable in response to energization thereof to advance the sparking time, and electrically operated intake air heating means electrically connected to the control means, and operable in response to energization thereof to discontinue heating the incoming air, and the control means is inoperable, when the selector switch is in the liquid fuel position, to energize the spark advance means and the air intake means; and is operable, when the selector switch is in the gaseous fuel position and in response to an amount of vacuum above the predetermined level, to deenergize the spark advance means and the inlet air heating means, and is also operable, when the selector switch is in the gaseous fuel position and in response to an amount of vacuum below the predetermined level, to energize the spark advance means and the inlet air heating means, and thereafter to retain energization of the spark advance means and the intake air heating means regardless of vacuum variation.

In one embodiment of the invention, the selector switch comprises a gaseous fuel terminal, a liquid fuel terminal, and a primary switch member connected to a source of direct current and movable between a first position energizing the gaseous fuel terminal and a second position energizing the liquid fuel terminal, and the control means further includes first switch means including a first terminal connected to the gaseous fuel control valve, to the spark advance means, and to the intake air heating means, a first switch member electrically connected to the gaseous fuel terminal, movable relative to a position energizing the first terminal, and thereby energizing the gaseous fuel control valve, the spark advance means, and the intake air heating means, and biased away from the first terminal, and means for holding the first switch member in the position energizing the first terminal in response to energizing of the first terminal, a second switch means including a terminal connected to the gaseous fuel control valve, a holding terminal, a second switch member electrically connected to the liquid fuel terminal of the selector switch, movable between a first position engaging said first terminal and a second position engaging the holding terminal and biased to said first position, and means connected to the holding terminal for holding the second switch member in the second position when the holding terminal is energized by the second switch member, vacuum switch means connected to a source of direct current and to the first and second switch means and operable between an open position in response to the presence of an amount of vacuum above the predetermined level and a second position which is normally closed in the absence of the presence of an amount of vacuum above the predetermined level and which is operable to connect the first switch member to the first terminal and the second switch member to the holding terminal, and a diode for preventing energization of the spark advance means and the intake air heating means when the primary switch member is in the liquid fuel position.

In one embodiment of the invention, the engine includes a fuel inlet manifold and the vacuum switch communicates with the fuel inlet manifold and is subject to the pressure variation in the fuel inlet manifold.

Other features and advantages of the embodiments of the invention will become known by reference to the following general description, claims and appended drawings.

IN THE DRAWINGS

FIG. 1 is a schematic view of one embodiment of a control apparatus for selectively operating an internal combustion engine on differing fuels.

Before explaining one embodiment of the invention in detail, it is to be understood that the invention is not limited in its application to the details of construction and the arrangement of components set forth in the following description or illustrated in the drawings. The invention is capable of other embodiments and of being practiced and carried out in various ways. Also, it is to be understood that the phraseology and terminology employed herein is for the purpose of description and should not be regarded as limiting.

GENERAL DESCRIPTION

Shown in FIG. 1 is control apparatus 11 for selectively operating an internal combustion engine 13 on a first or gaseous fuel and on a second or liquid fuel. The engine includes a carburetor 15 incorporating a float bowl 17 which is connected through a supply line 19 with a source 21 of liquid fuel, such as, for instance, gasoline. Other liquid fuels could be used. The engine 13 also includes a gaseous fuel air mixer 23 which communicates with the carburetor 15, and which is connected through a supply line 25 with a source 27 of gaseous fuel, such as, for instance, natural gas. Other gaseous fuels could be used.

The engine 13 also includes an ignition system (not shown) which incorporates spark advancing means 31 (schematically illustrated) for varying the time of sparking between retarded sparking and advanced sparking. Such spark advancing means 31 is biased toward retarded sparking, permits variation in the time of sparking operation when the engine 13 is operating on liquid fuel, and maintains advances sparking when the engine 13 is operating on gaseous fuel. The spark advance means 31 is operative in response to electrical energization to maintain the spark advanced when operating on gaseous fuel. Other than as explained above, the details of the spark advancing means 31 do not form a part of this invention. One suitable spark advancing means is disclosed in application Ser. No. 314,227, filed Oct. 23, 1981 and entitled "Spark Advance Mechanism for Dual Fuel Engine" which is incorporated herein by reference.

The engine 13 also includes means 33 for heating the intake air when the engine 13 is operating on liquid fuel. The intake air heating means 33 is operative to prevent heating of the incoming air in response to electrical energization and, in the absence of electrical energization, serves to heat the incoming air. Any suitable intake air heating means can be employed.

The engine 13 also includes control means 41 for selective change-over between use of liquid fuel and gaseous fuel. In this regard, the control means 41 includes a liquid fuel control valve 43 which is incorporated in the liquid fuel supply line 19, which is movable between open and closed positions, which is biased to the closed position, and which, in response to electrical energization, moves to the open position to afford liquid fuel flow to the engine 13.

The control means 41 also includes a gaseous fuel control valve 45 which is incorporated in the gaseous fuel supply line 25, which is movable between open and closed positions, which is biased to the closed position, and which, in response to electrical energization, moves to the open position to afford gaseous fuel flow to the engine.

Still further in addition, the control means 41 includes a vacuum control switch 47 which is subject to variation in the amount of vacuum, which is normally closed, and which opens in response to the presence at the vacuum switch 47 of an amount of vacuum above a predetermined amount.

Still further in addition, the control means 41 includes a primary or fuel selector switch 51 which is operator-controlled and which is movable between a first or gaseous fuel position, and a second or liquid fuel position.

The control means 41 is operable, when the selector switch 51 is in the liquid fuel position, to energize the liquid fuel control valve 43, thereby opening the liquid fuel control valve 43. In addition, the control means 41 is operable, when the selector switch 51 is in the liquid fuel position and in response to the presence at the vacuum switch 47 of an amount of vacuum above the predetermined level, to energize the gaseous fuel control valve 45, and thereby open the gaseous fuel control valve 45.

Still further in addition, the control means 41 is operable, when the selector switch 51 is in the liquid fuel position and in response to the presence at the vacuum switch 47 of an amount of vacuum below the predetermined level to deenergize the gaseous fuel control valve 45, and therefore close the gaseous fuel control valve, and thereafter to retain the gaseous fuel control valve 45 deenergized regardless of variation of vacum until the fuel selector switch 51 is moved to the gaseous fuel position.

The control means 41 is also inoperative, when the selector switch 51 is in the gasoline position, to energize the spark advance means 31 and the intake air heating means 33.

The control means 41 is also operable, when the selector switch 51 is in the gaseous fuel position, to deenergize the liquid fuel control means 43, and thereby closing the liquid fuel control valve 43. In addition, the control means 41 is also operable when the selector switch 51 is in the gaseous fuel position and in response to the presence at the vacuum switch 47 of an amount of vacuum above the predetermined level, to deenergize the gaseous fuel control valve 45, and thereby close the gaseous fuel control valve 45, to deenergize the spark advance means 31, and to deenergize the intake air heating means 33. Still further in addition, the control means 41 is also operable, when the selector switch 51 is in the gaseous fuel position and in response to the presence at the vacuum switch 47 of an amount of vacuum below the predetermined level, to energize the gaseous fuel control valve 47, and thereby open the gaseous fuel control valve 45, to energize the spark advance means 31, and the intake air heating means 33, and to thereafter retain energization of the gaseous fuel control valve 45, the spark advance 31 and the intake air heating means 33, regardless of variation in vacuum until movement of the fuel selector switch 51 to the liquid fuel position by an operator.

More particularly, the selector switch 51 comprises a gaseous fuel terminal 53, a liquid fuel terminal 55, and a primary switch member 57 connected to a source 59 of direct current and movable between a first position energizing the liquid fuel terminal 55.

The control means 41 further includes a first switch means 61 including an energizing and holding terminal 63 connected to the gaseous fuel control valve 45, to the spark advance means 31, and to the intake air heating means 33. In addition, the first switch means 61 includes a first switch member 65 connected to the gaseous fuel terminal 53 of the selector switch 51 and movable to and from a position energizing the energizing and holding terminal 63, means (not shown) biasing the first switch member 65 away from the energizing and holding terminal 63, and means connected to the energizing and holding terminal 63 for holding the first switch member 65 in the position energizing the energizing and holding terminal 63 when the energizing and holding terminal is energized.

The control means 41 also includes a second switch means 71 including a terminal 73 connected to the gaseous fuel control valve 45, a holding terminal 77, and a second switch member 79 electrically connected to the liquid fuel terminal 55 of the selector switch 51 and movable between a first position energizing the terminal 73 connected to the gaseous fuel control valve 45 for energization thereof, and a second position energizing the holding terminal 77, means (not shown) biasing the second switch member 79 to the first position, and means connected to the holding terminal 77 for holding the second switch member 79 in the second position against the action of the biasing means when the holding terminal 77 is energized.

Still more specifically, the first and second switches 61 and 71 respectively include solenoid coils 81 and 83 which, when energized, cause movement of the respective first and second switch members 65 and 79 from their biased positions to their respective positions in engagement with the energizing and holding terminal 63 and the holding terminal 77.

The vacuum switch 47 includes a switch member 93 which is connected to the source 59 of direct current and which is movable between open and closed positions relative to a second terminal 95 which, in turn, is connected through diodes 97 and 99 to the respective solenoid coils 81 and 83.

The switch member 93 is biased by a spring 101 to the closed position, and opens in response to the presence at the vacuum switch 47 of an amount of vacuum above a predetermined level. In this last regard, the vacuum switch is connected by a suitable conduit 103 to the engine intake manifold 105 and therefore senses the vacuum condition at the intake manifold 105. In this regard, as already indicated, a small amount of vacuum below the predetermined level is ineffective to open the vacuum switch 47. Such small amounts of vacuum occur during high speed and acceleration conditions in which the engine throttle 107 is opened and, thus, there is no impediment to fuel mixture flowing to the engine cylinders (not shown). However, during idling and lesser speed operations, the engine throttle 107 is either closed or partially opened, causing a greater amount of vacuum to be present in the engine intake manifold 105. When such a greater amount of vacuum above the predetermined level is present, the vacuum switch 47 opens against the bias of the spring 101.

The control means 41 also includes a diode 111 which prevents energization of the intake air heating means 33 and the spark advance means 31 when the fuel selector switch 51 is in the liquid fuel position and the second switch member 79 is in the first position energizing the terminal 73 and hence the gaseous fuel control valve 45.

Still further, a diode 113 is interposed in the electrical connection between the second switch member 79 and the liquid fuel terminal 55 of the primary switch 51 to prevent current flow from the second switch member 79 to the liquid fuel terminal 55 of the primary switch 51. Still further in addition, a diode 115 is provided between the energizing terminal 63 of the first switch and the solenoid coil 81 so as to prevent flow from the solenoid coil 81 to the gaseous fuel control valve 45 and/or the spark advance means 31 and/or the intake heating means 31, while at the same time, affording current flow to the solenoid coil 81 for holding action of the first switch member 65 in engagement with the energizing terminal 63.

In operation, when switching from liquid fuel to gaseous fuel, the operator moves the fuel selector switch 51 to the gaseous fuel position. As a result, the liquid fuel control valve 43 is consequently deenergized and turns off the liquid fuel supply to the carburetor 15. However, the engine continues to run on the liquid fuel in the carburetor bowl 17. The inlet manifold vacuum remains above the predetermined level of the vacuum switch 47 at idle or normal road speeds until the engine begins to run out of the liquid fuel in the fuel bowl 17. The vacuum then drops to an amount less than or below the predetermined level thereby closing the vacuum switch 47 which energizes the solenoid coils 81 and 83. The first solenoid coil 81 acts to displace the first switch member 65 to the terminal 63, thereby energizing the gaseous fuel control valve 45 to the open position, and thereby also energizing the spark advance means 31 and the inlet air heating means 33. Energization of the terminal 63 also serves to hold the solenoid coil 81 in the energized state, thereby retaining the gaseous fuel control valve 45 in opened condition, regardless of variation of the vacuum condition at the vacuum switch 47.

To change to liquid fuel from gaseous fuel, the operator moves the fuel selector switch 51 to the liquid fuel position. Such movement energizes the liquid fuel control valve 43 to the open position and the carburetor bowl 17 begins to fill. However, the engine 13 will not run on liquid fuel until the carburetor bowl 17 is nearly full. During the time interval when the carburetor bowl is filling, the gaseous fuel control valve 45 is retained open by engagement of the second switch member 79 with the terminal 73. Thus, the engine 13 continues to run on gaseous fuel with the vacuum condition at the vacuum switch above the predetermined level until the engine 13 begins to run on both fuels. The vacuum condition at the vacuum switch 47 then drops below the predetermined level, thereby closing the vacuum switch 47, which closure energizes the second solenoid coil 83. Energizing of the second solenoid coil 83 shifts the second switch member 79 to the holding terminal 77, thereby deenergizing the gaseous fuel control valve 45 so as to effect closure thereof. At the same time, energization of the holding terminal 77 serves to latch the second solenoid coil 83 in an energized state so that the gaseous fuel control valve 45 remains in the off position, notwithstanding variation in vacuum condition at the vacuum switch 47. In addition, the spark advance means 31 and the inlet air heating means 33 are opened immediately upon the shifting of the fuel selector switch 51 to the liquid fuel position. If such deenergization of the spark advance means 31 and the inlet air heating means 33 is not accomplished, the vacuum condition at the vacuum switch 47 may remain greater than the predetermined level when idling on both fuels, thereby preventing closure of the vacuum switch 47 and completion of the change-over to liquid fuel.

The diode 111 prevents the inlet air heating means and the spark advance means from being energized during the switch-over to liquid fuel. The diode 113 prevents the fuel control valve 43 from being energized during normal gaseous fuel operation. The disclosed automatic change-over system will work as described at idle and steady speeds below about 50 mph. If the change-over is attempted at a heavy load, low-vacuum conditions, the engine will lose power for a few seconds. However, inertia of the vehicle powdered by the engine 13 will drive the engine 13 until the correct fuel mixture is supplied.

Prior currently available dual fuel systems for employing liquid fuel and gaseous fuel require the operator to go through a specified procedure to change fuel. In these systems, to change fuel from gasoline to natural gas, the operator turns off the gasoline valve, waits until the fuel in the carburetor is used, and then turns on the natural gas. To change back to gasoline, the operator turns on the gasoline valve, waits until the engine begins to flood, and then turns off the natural gas valve. The operator must know the specific procedure required for the particular conversion system in order to make a fuel change. Thus the disclosed apparatus 11 for shifting from gaseous fuel to liquid fuel, and vice-versa, is unique and simplifies the previous change-over procedure.

Various of the features of the invention are set forth in the following claims.

I claim:

1. Apparatus for controlling operation of an internal combustion engine which is selectively operable using gaseous fuel or liquid fuel, said apparatus comprising a gaseous fuel supply line extending between the engine and a source of gaseous fuel, a liquid fuel supply line extending between the engine and a source of liquid fuel, and means for controlling supply to the engine of the gaseous fuel and the liquid fuel, said control means including an operator controlled fuel selector switch movable between a gaseous fuel position and a liquid fuel position, said control means being operable following prior engine operation with gaseous fuel and in response to movement of said fuel selector switch from said gaseous fuel position to said liquid fuel position for permitting liquid fuel flow through said liquid fuel supply line, for permitting continued gaseous fuel flow through said gaseous fuel supply line until initiation of liquid fuel combustion, and for thereafter preventing further gaseous fuel flow through said gaseous fuel supply line until repositioning of said fuel selector switch to said gaseous fuel position, said control means also being operable following prior engine operation with liquid fuel and in response to movement of said fuel selector switch from said liquid fuel position to said gaseous fuel position for preventing further liquid fuel flow through said liquid fuel supply line, for preventing gaseous fuel flow through said gaseous fuel supply line until termination of liquid fuel combustion, and for thereafter permitting gaseous fuel flow through said gaseous fuel supply line until repositioning of said fuel selector switch to said liquid fuel position.

2. Apparatus in accordance with claim 1 wherein said control means also includes vacuum operated means responsive to engine vacuum conditions for controlling gaseous fuel flow through said gaseous fuel supply line.

3. Apparatus for controlling operation of an internal combustion engine which is selectively operable using gaseous fuel or liquid fuel, said apparatus comprising means for supplying a gaseous fuel to the engine, means for supplying a liquid fuel to the engine, and control means connected to a source of vacuum which is responsive to engine operation and which varies relative to a predetermined level, said control means including a fuel selector switch movable between a gaseous fuel position and a liquid fuel position, an electrically operated, normally closed gaseous fuel control valve which is located in said gaseous fuel supply means, which is operable between open and closed positions, and which is opened in response to electrical energization thereof, and an electrically operated, normally closed liquid fuel control valve which is located in said liquid fuel supply means, which is operable between open and closed positions, and which is opened in response to electrical energization thereof, said control means being operable, when said selector switch is in said liquid fuel position, to energize said liquid fuel control valve, thereby opening said liquid fuel control valve, said control means also being operable, when said selector switch is in said liquid fuel position and in response to the presence of an amount of vacuum above said predetermined level to energize said gaseous fuel control valve, said control means also being operable, when said selector switch is in said liquid fuel position and in response to the presence of an amount of vacuum below said predetermined level, to deenergize said gaseous fuel control valve, and thereby close said gaseous fuel control valve, and thereafter to retain said gaseous fuel control valve deenergized regardless of vacuum variation, said control means also being operable, when said selector switch is in said gaseous fuel position, to deenergize said liquid fuel control valve, thereby closing said liquid fuel control valve, said control means also being operable, when said selector switch is in said gaseous fuel position and in response to an amount of vacuum above said predetermined level, to deenergize said gaseous fuel control valve, thereby closing said gaseous fuel control valve, and said control means also being operable, when said selector switch is in said gaseous fuel position and in response to an amount of vacuum below said predetermined level, to energize said gaseous fuel control valve and thereby open said gaseous fuel control valve, and thereafter to retain energization of said gaseous fuel control valve regardless of vacuum variation.

4. Apparatus in accordance with claim 3 wherein said apparatus further includes electrically operated spark advance means electrically connected to said control means and operable in response to energization thereof to advance the sparking time, and electrically operated intake air heating means electrically connected to said control means, and operable in response to energization to prevent heating of the incoming air, and wherein said control means is inoperable, when said selector switch is in said liquid fuel position, to energize said spark advance means and said air intake means, and wherein said control means is also operable, when said selector switch is in said gaseous fuel position and in response to an amount of vacuum above said predetermined level, to deenergize said spark advance means and said inlet air heating means, and wherein said control means is also operable, when said selector switch is in said gaseous fuel position and in response to an amount of vacuum below said predetermined level, to energize said spark advance means and said inlet air heating means, and thereafter to retain energization of said spark advance means and said intake air heating means regardless of vacuum variation.

5. Apparatus in accordance with claim 4 wherein said selector switch comprises a gaseous fuel terminal, a liquid fuel terminal, and a primary switch member connected to a source of direct current and movable between a first position energizing said gaseous fuel terminal and a second position energizing said liquid fuel terminal, wherein said control means further includes first switch means including a first terminal connected to said gaseous fuel control valve, to said spark advance means, and to said intake air heating means, a first switch member electrically connected to said gaseous fuel terminal and movable relative to a position energizing said first terminal, and thereby energizing said gaseous fuel control valve, said spark advance means, and said intake air heating means, said first switch member being biased away from said first terminal, and means for holding said first switch member in said position energizing said first terminal in response to energizing of said first terminal, wherein said control means further includes second switch means including a terminal connected to said gaseous fuel control valve, a holding terminal, a second switch member electrically connected to said liquid fuel terminal and movable between a first position engaging said terminal connected to said gaseous fuel control valve for energizing thereof, and a second position engaging said holding terminal, said second switch member being biased to said first position, and means connected to said holding terminal for holding said second switch member in said second position when said holding terminal is energized by said second switch member, wherein said control means further includes vacuum switch means connected to a source of direct current and to said first and second switch means and operable between an open position in response to the presence of an amount of vacuum above said predetermined level and a second position which is normally closed in the absence of the presence of an amount of vacuum above said predetermined level and which is operable to connect said first switch member to said first terminal and said second switch member to said holding terminal, and wherein said control means further includes a diode for preventing energization of said spark advance means and said intake air heating means when said primary switch member is in said liquid fuel position.

6. Apparatus in accordance with claim 5 wherein said engine includes a fuel inlet manifold and said vacuum switch communicates with said fuel inlet manifold and is subject to the pressure variation in said fuel inlet manifold.

* * * * *